US005456457A

United States Patent [19]

Kerstein et al.

[11] Patent Number: 5,456,457

[45] Date of Patent: Oct. 10, 1995

[54] HIGH SPEED SEPARATOR WITH MOVABLE HOLD BACK BELT FOR HIGH SPEED FLATS FEEDER

[75] Inventors: Melvin T. Kerstein, Lincolnwood; Thomas Faber, Skokie; David D. Filicicchia, Schaumburg; Kenneth L. Guenther, Park Ridge; Jospeh Kalika, Niles; K. George Rabindran, Morton Grove, all of Ill.

[73] Assignee: Bell & Howell Company, Skokie, Ill.

[21] Appl. No.: 263,647

[22] Filed: Jun. 20, 1994

[51] Int. Cl.[6] ..... B65H 5/00

[52] U.S. Cl. ..... 271/10.07; 271/35; 271/122; 271/270; 271/272; 271/265.02; 271/265.04

[58] Field of Search ..... 271/35, 122, 265, 271/270, 272–274, 312, 182, 307, 259, 10

[56] References Cited

U.S. PATENT DOCUMENTS

| | | | |
|---|---|---|---|
| 3,754,754 | 8/1973 | Peterson . | |
| 3,857,559 | 12/1974 | McInerny . | |
| 3,970,298 | 7/1976 | Irvine et al. . | |
| 4,522,385 | 6/1985 | Stefansson . | |
| 4,575,068 | 3/1986 | Kato | 271/122 |
| 4,691,913 | 9/1987 | Frank . | |
| 4,709,911 | 12/1987 | Saiki et al. . | |
| 5,121,915 | 6/1992 | Duncan et al. | 271/265 |
| 5,257,777 | 11/1993 | Kalika et al. . | |
| 5,282,010 | 1/1994 | Popovic | 271/308 |
| 5,386,984 | 2/1995 | Toso et al. | 271/122 |

FOREIGN PATENT DOCUMENTS

| | | | |
|---|---|---|---|
| 0060596 | 9/1982 | European Pat. Off. . | |
| 0185862 | 7/1986 | European Pat. Off. . | |
| 0198242 | 11/1984 | Japan | 271/122 |

*Primary Examiner*—H. Grant Skaggs
*Attorney, Agent, or Firm*—Welsh & Katz, Ltd.

[57] ABSTRACT

An apparatus for separating and advancing documents includes a first assembly having movable belts for frictionally engaging and advancing one of the documents along a path, and a second assembly having stationary belts and retrogressingly moving a portion of an endless belt along the path to frictionally engage and halt the remainder of the documents. The retrogressional movement of the endless belt distributing wear experienced by the engaging and halting of documents over the length of the endless belt. The movable belts of the first assembly and the belts of the second assembly are disposed in relative juxtaposition whereby the one document is gripped between the first assembly and second assembly and advanced along the path under the influence of the first assembly.

13 Claims, 5 Drawing Sheets

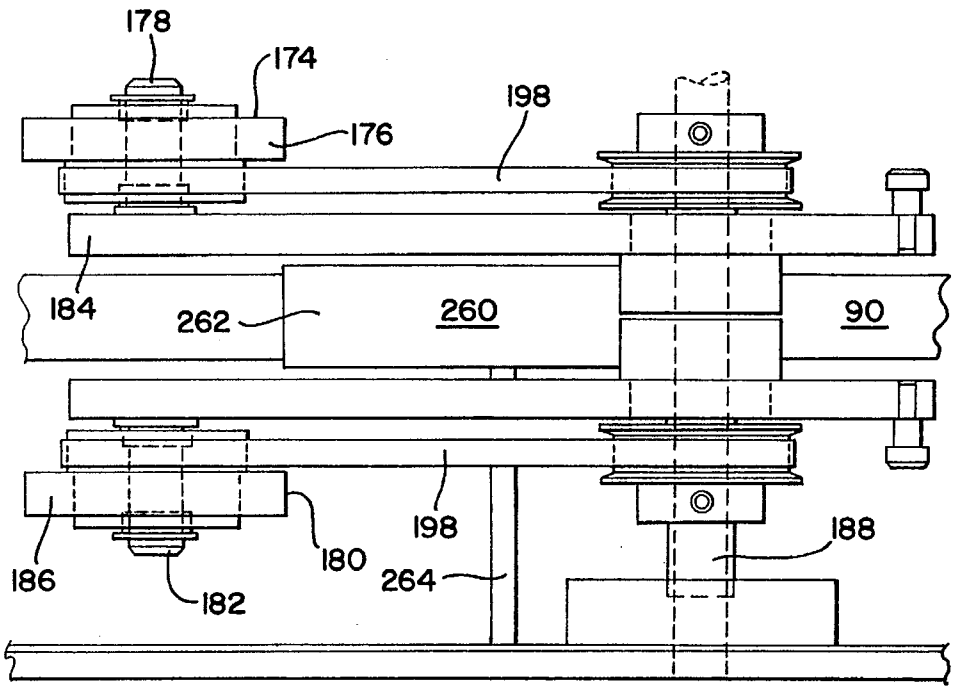
FIG. IC
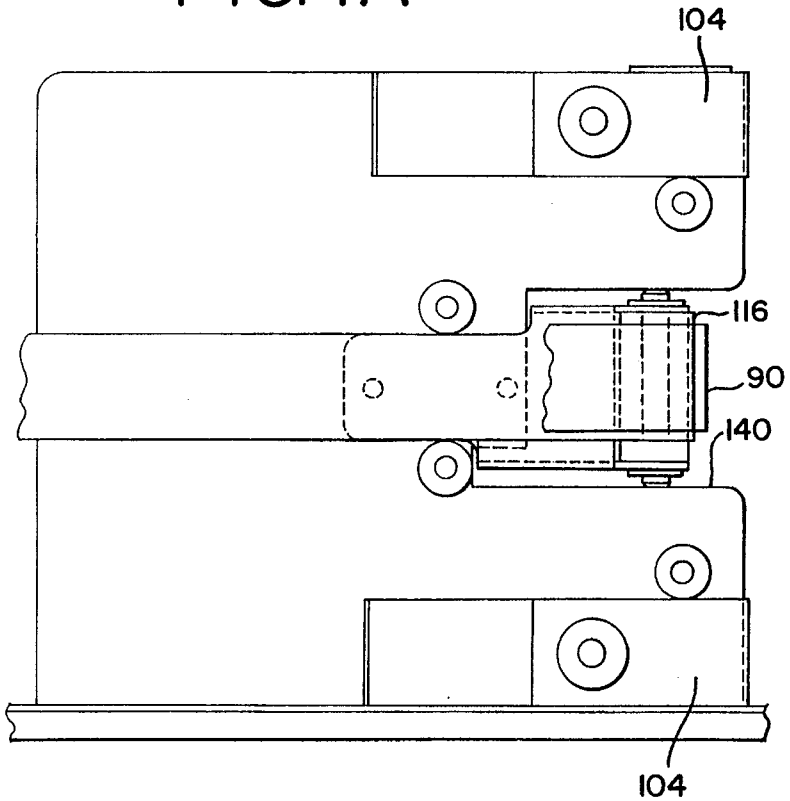
FIG. IA

HIGH SPEED SEPARATOR WITH MOVABLE HOLD BACK BELT FOR HIGH SPEED FLATS FEEDER

FIELD OF THE INVENTION

The present invention relates to automated sorting apparatus used to rapidly handle and sort large volumes of documents, and specifically to an apparatus for separating single pieces of so-called "flat mail" from large groups of such mail, even in situations when the mail is randomly collated as to size and type.

BACKGROUND OF THE INVENTION

Flat mail, or "flats" are terms used to refer to mail other than normal letter-sized envelopes, and includes magazines, oversized envelopes, and thin mailer sheets which are folded over in half, thirds, or quarters, and fastened by a staple, tape or adhesive. Presently, such mail requires a significant amount of handling by Postal Service personnel, due to the inability of commonly available automated mail handling equipment to quickly separate individual pieces of flat mail for reading and subsequent sorting.

Flats, as well as letter-sized envelopes, are usually fed in horizontal stacks of vertically oriented pieces to automated machinery, which separates or singulates individual pieces from the stack, positions each piece for manual or automatic reading of the Zip Code, and subsequent sorting of each piece to a bin corresponding to the Zip Code or a portion thereof, such as the last three digits. Regardless of whether the reading is done manually or automatically, the separation equipment must properly separate and position each document for fast and efficient reading without jamming. Also, the passage of "doubles", or two pieces temporarily stuck together, through the separation path is to be avoided.

Conventional equipment has the tendency to damage or mutilate flat mail during the separation process. Folded over pieces and magazine pages are often skewed and torn by being subjected to uneven conveyor roller or belt pressures, larger envelopes are often creased, crumpled or inadvertently folded, and smaller pieces sometimes temporarily adhere to larger ones.

Various systems have been proposed for providing trouble free and rapid automatic separation, singulation and sorting of flats. One such system is described in U.S. Pat. No. 5,257,777, incorporated by reference herein, and commonly owned by the assignee of this application. The described singulator uses a movable set of belts to frictionally engage one of the surfaces of an envelope within a shingled array of envelopes to separate and transport that envelope to a conveying path. The singulator also employs a set of hold back belts to frictionally engage and halt the advance of the other envelopes thereby allowing the separation. However, the frictional engagement to halt the advance of the other envelopes creates wear in the document separator which after the processing of large amounts of envelopes may impact the ability of the hold back belts to hold back the remainder of the envelopes. In addition, particularly when high volume separation is occurring, residue has a tendency to be deposited on the hold back belts by the envelopes. This residue may reduce the ability of the hold back belts to frictionally engage the other documents to halt their advance.

Thus, there is a need for an apparatus which rapidly separates and singulates flat mail with a relatively simple yet cost effective configuration. There is also a need for such an apparatus which grips mail pieces of all sizes over a substantial surface area of each piece for rapid transmission along the separation path to prevent crimping of the mail piece. There is also a need for such a separator which accommodates pieces of flat mail of varying thicknesses, from thick magazines to single sheets, without jamming. There is a further need for a flat mail separator which is capable of separating as many as 10,000 pieces of mail per hour and accommodating the wear that such a high volume may create.

SUMMARY OF THE INVENTION

Accordingly, the present invention provides a flat mail separator and singulation apparatus for high volume mail processing which meets the above-identified needs by receiving an array of shingled documents from a document feeder, holding the shingled array at an entrance nip, separating a single document from the shingled array and advancing the separated document in a vertical orientation along a document path at high velocity. Additionally, the present invention maintains the ability to separate documents while processing a high volume of mail by distributing the wear which typically occurs at certain locations in the separator device.

More specifically, the present belt separator apparatus includes a moving first assembly for frictionally engaging and advancing one of the plurality of documents along a document conveying path, and a second assembly having a moving element for frictionally engaging and halting the advance of the remainder of the plurality of documents. The first assembly and second assembly each include a plurality of belts, and are disposed in juxtaposition whereby the one document is gripped between the first assembly and second assembly and advanced along the path between the two assemblies under the influence of the first assembly.

In a preferred embodiment, the moving element of the second assembly includes an endless hold back belt forming an inner reach portion along the document conveying path for halting the advance of the remainder of the documents and an arrangement for continuously retrogressing portions of the endless belt through the inner reach portion to distribute wear of the endless belt along the entire length of the belt.

Also, the belts of the moving and stationary elements are vertically spaced relative to each other such that they are interleaved, and contact the front and back surfaces, respectively, of the one document to provide a column strength to the one document over a substantial surface area as the document advances through the apparatus. In this manner, portions of the one document are prevented from being crimped between the first assembly and the second assembly element by denying the document lateral space where a crimp could form.

The apparatus preferably includes an accelerator mechanism for inducing a high velocity to the one document in the path after it has been separated from the shingled array. The one document is subsequently passed to additional handling equipment. Once the first document of the shingled array is advanced along the path, each document of the array is similarly advanced seriatim. In addition, a sensing mechanism is provided to monitor the number of documents in the apparatus and to control the document feeder appropriately to maintain a steady flow of shingled documents into the apparatus

BRIEF DESCRIPTION OF THE DRAWINGS

FIG. 1A is a section taken along the line A—A of FIG. 1 and in the direction indicated generally;

FIG. 1C is a section taken along the line C—C of FIG. 1 and in the direction indicated generally;

DESCRIPTION OF THE PREFERRED EMBODIMENTS

Figure 1:
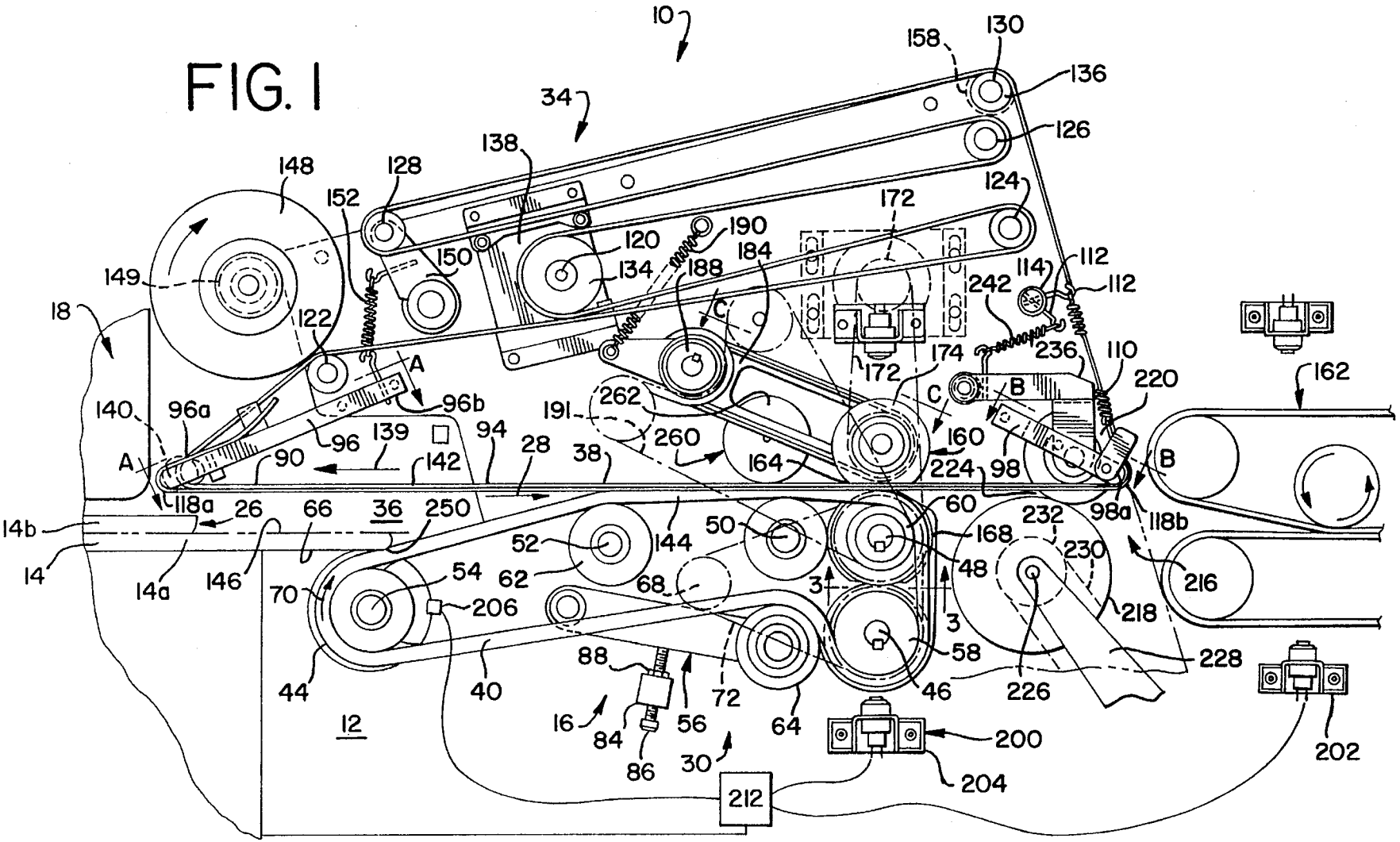
FIG. 1 is an overhead plan view of the belt separator of the invention.
Figure 2:
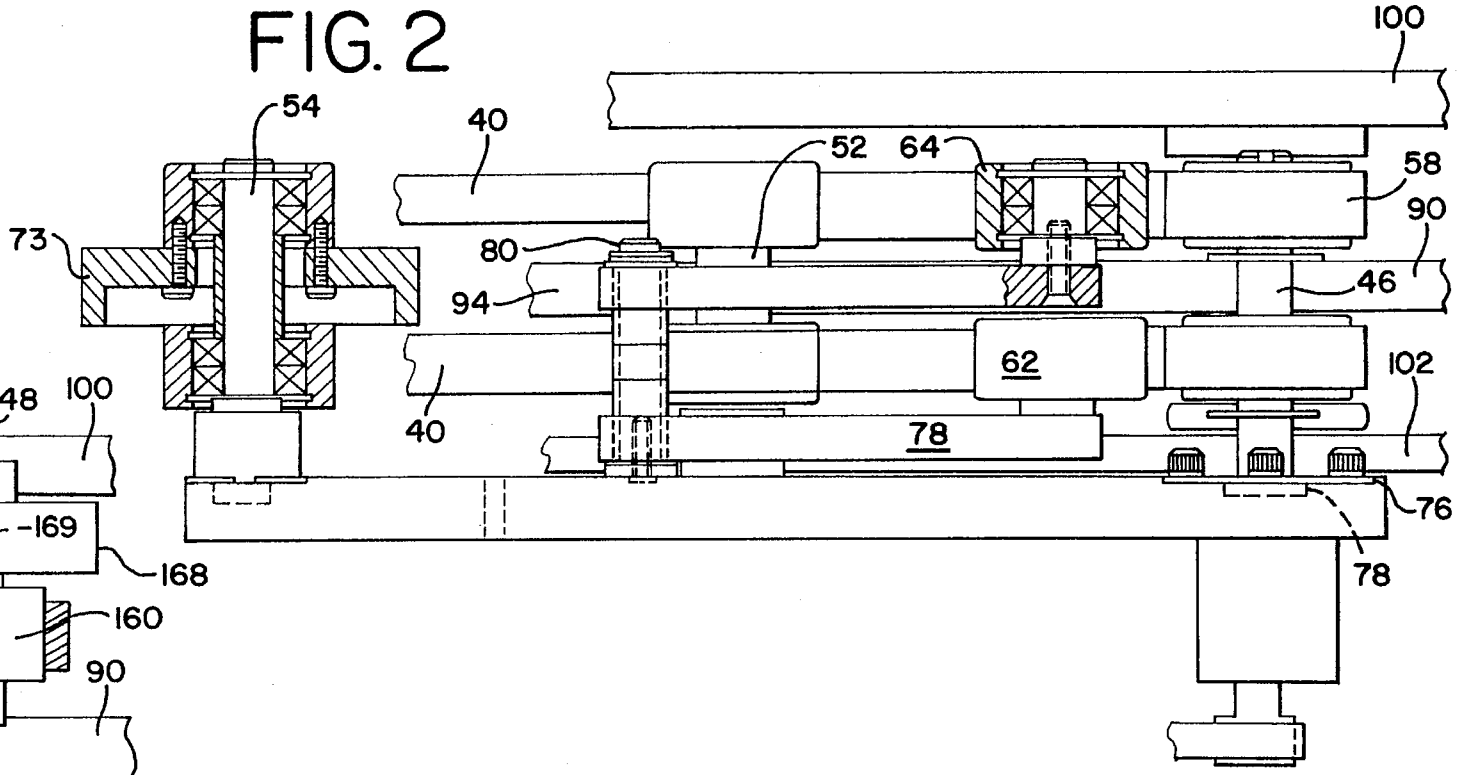
FIG. 2 is a front elevational view of the apparatus of FIG. 1 in partial section.

Referring now to FIG. 1, the belt separator of the present invention is generally indicated at 10. The separator 10 includes a support frame 12 preferably having a configuration which facilitates integration with other conventional mail handling and sorting apparatus. In FIGS. 1 and 2, pieces of flat mail such as documents, flats, envelope or the like, generally designated at 14, are advanced in a left-to-right direction as seen from a front 16 of the separator 10.

A document feeder 18 is located just to the left of the apparatus 10 and is contemplated to be any one of various designs well known to skilled practitioners. However, a preferred feeder 18 (best seen in FIG. 3) includes at least one conically shaped singling disk 20 which rotates axially in the direction indicated by arrow 22. The document feeder 18 receives horizontal stacks of vertically positioned flat mail pieces 14, each of which is oriented so that the addressed side faces the front 16 of the separator 10. Through the action of the disk 20 and a back up roller 24, the feeder 18 creates a shingled array 26 of the leading pieces or documents 14 of flat mail, designated 14*a* and 14*b*, respectively which are shingled so that the front most document 14*a* is advanced at a faster velocity that the subsequent document 14*b* in the shingled array. Although only three shingled documents 14 are depicted in FIG. 1; it will be appreciated the additional documents are normally provided in the array.

The shingled array 26 encounters the separator 10 by being advanced into a path 28 defined by a moving first assembly 30 and a second assembly 34. An entrance portion 36 of the path 28 is wedge or triangular shaped as viewed from above, due to the relative distances between corresponding portions of the first assembly 30 and second assembly 34. To the right of the entrance portion 36, and beginning at an entrance nip 38, the path 28 is generally linear through the rest of the separator 10.

The moving first assembly 30 is designed for frictionally engaging and individually advancing each one of the documents 14 in the shingled array 26 along the path 28, while the second assembly 34 is designed for supporting each advanced document 14*a*, and also for frictionally engaging and halting the advance of the remaining documents, represented by the documents 14*b*, such that only one document at a time is passed through the separator 10. In addition, the second assembly 34 provides the normal force to hold the document 14*a* against the first assembly 30 causing the document to advance through the separator 10.

Referring to FIGS. 1 and 2, the first assembly 30 preferably includes a pair of document drive belts 40, which are made of resilient, durable material and preferably have a textured outer surface 44 to enhance friction contact between the belts 40 and the documents 14. Although only two drive belts 40 are provided, depending on the application and size of the apparatus 10, additional drive belts are contemplated.

The drive belts 40 are disposed in vertically spaced, parallel orientation relative to each other around a first or outer drive spindle 46, a second or inner drive spindle 48, three idler spindles respectively designated 50, 52 and 54, and tensioning roller assembly 56. The outer drive spindle 46 has a pair of vertically spaced drive rollers 58, the inner drive spindle 48 has a correspondingly spaced pair of drive rollers 60 and each of the idler spindles 50, 52, 54, has a correspondingly spaced pair of idler rollers 62. The tensioning roller assembly 56 also has a correspondingly spaced pair of idler rollers 64. The belts 40 of the first assembly 30 thus define a vertical contact surface for engaging a front surface 66 of each of the documents 14. A motor 68 drives the outer drive spindle 46 and inner drive spindle through a drive belt 72 so that the drive belts 40 follow a clockwise movement indicated by the arrows 70.

In the preferred embodiment, idler spindle 50 is mounted more closely adjacent the path 28 than spindle 52 to extend the central position of belts 40 outward as they pass adjacent the second assembly 34, thereby increasing the frictional contact between the belts 40 and the documents 14 as the documents pass through this point of the separator 10.

The idler spindle 54 is linearly and spatially displaced and slightly offset forwardly from spindle 52 to define the generally triangular shaped entrance portion 36. Thus at spindle 54, the first assembly 30 is at a first, relatively distant position relative to the second assembly 34, while at the spindles 48, 50, 52 the first assembly and second assembly are in closely adjacent relationship to each other. To prevent envelopes from contacting the left end of the assembly 30, a spacer roller 73 may be placed about spindle 54 between the rollers 62. The spindles 50, 52, 54 are mounted to the frame 12 by brackets 74 equipped with bearings 76 as are well known to skilled practitioners.

The tensioning roller assembly 56 selectively adjusts and maintains the tension of the drive belts 40. Each of the idler rollers 64 are mounted to one end of a corresponding pivot arm 78 with the other ends of the pivot arms pivotally mounted to a vertical post 80 which is fixedly attached to the support frame 12. Attached to the frame 12 and located along the length of the pivot arms 78 is a vertical stub post 84. A positioning bolt 86 for each of the pivot arms 78 is threaded through the member 84 with the end of the bolts contacting the pivot arms to selectively pivot the pivot arms and force the idler rollers 64 against the drive belts 40 to selectively tension the drive belts 40. A locking nut 88 may be threaded about the positioning bolt 86 to lock the position of the bolt once the desired tension in the drive belts 40 is achieved.

Figure 1B:
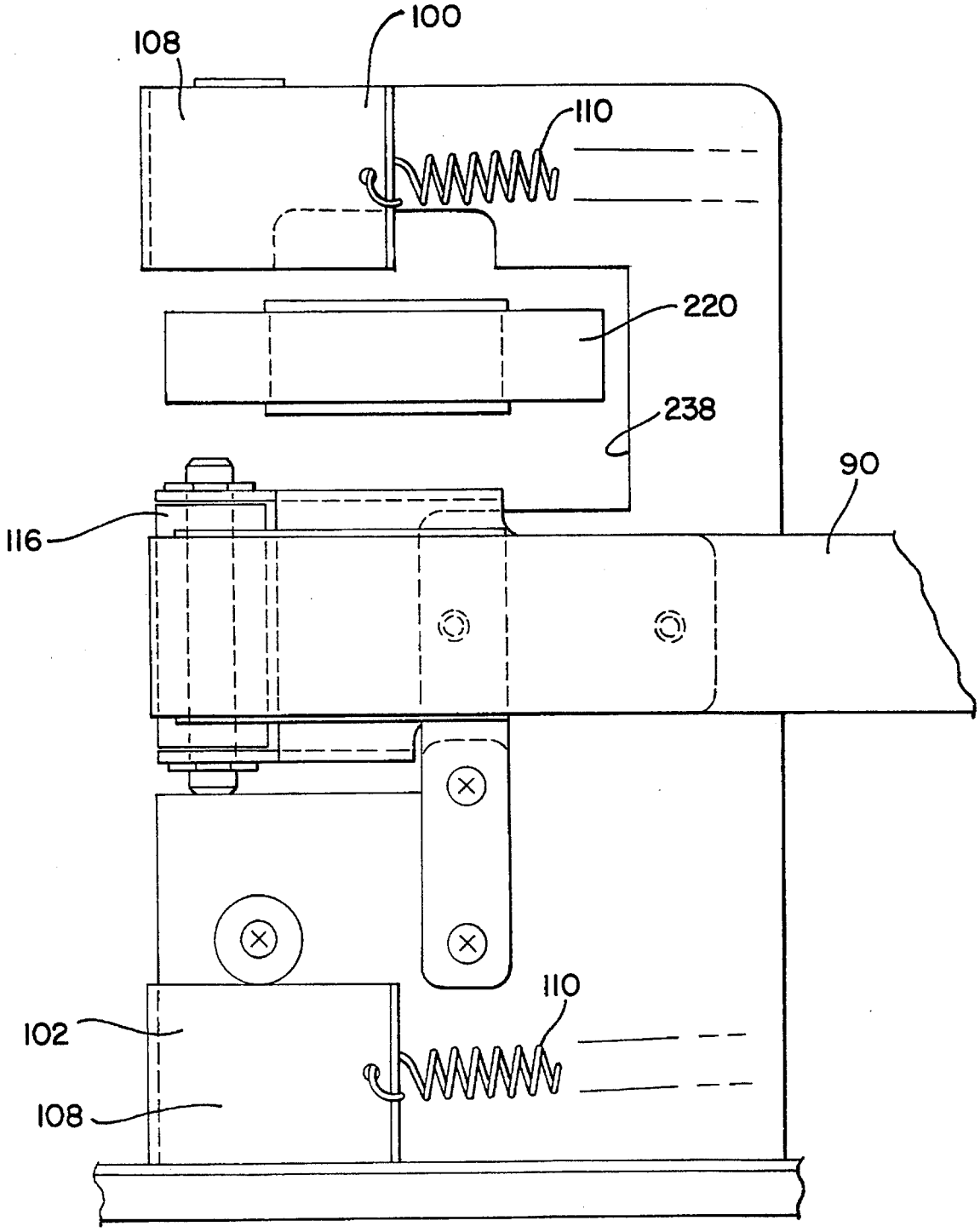
FIG. 1B is a section taken along the line B—B of FIG. 1 and the direction indicated generally.

Referring to FIGS. 1, 1A, and 1B, the second assembly 34 includes an endless holdback belt 90 with an inner reach 94 extending generally along the path 28. The belt 90 is driven so that the inner reach 94 moves from right to left as viewed in FIG. 1, in a direction opposite the direction of advancement of the singulated document 14*a* or in a retrogressing direction. Preferably the belt 90 moves at a slow speed such as approximately 6 inches per minute.

The second assembly 34 also includes a vertical plate 96 located on the left in FIG. 1 and vertical plate 98 located along the right in FIG. 1. Each of the vertical plates 96, 98 is secured to the support frame 12 and has an inner end 96*a* and 98*a* located closely adjacent the path 28. The left plate 96 is angled relative to the path 28 so that the inner end 96*a* is upstream of the outer end 96*b*. The right plate 98 is angled opposite to the left plate 96 with the inner end 98*a* downstream of the outer end 98*b*.

Referring also to FIG. 2, a pair of stationary hold back belts 100, 102 are mounted horizontally and extend from the left plate 96 to the right plate 98, facing the front 16 the separator 10 in a generally vertically spaced relationship relative to each other. For each belt 100, 102, a first end 104 is wrapped around the inner end 96*a* of the left support plate 96 to avoid creasing or folding and is secured to the rear side 106 of the plate 96. A second end 108 of each belt 100, 102 is wrapped around the inner end 98*a* of the right plate 98 and is secured to one end of a biasing spring 110. The other end of each of the biasing springs 110 is attached to a hook bolt 112 which is fixedly anchored to a vertical support post 114 attached to the support frame 12. In this manner, the springs 110 maintain a predetermined tension on the belts 100, 102 which keeps them taught, yet provides slack when the force of spring 110 is overcome, such as when a thick document is advanced along the path 28.

Referring back to FIG. 1, interdisposed between the belts 100, 102 and journaled to the inner end 96*a* of the left plate 96 and inner end 98*a* of the right plate 98 are idler rollers 116. The idler rollers 116 support the moving belt 90 to form the ends 118*a*, 118*b* of the inner reach portion 94. The moving belt 90 also extends around a drive spindle 120 and five idler spindles 122, 124, 126, 128 and 130. The drive spindle 120 has a roller 134 and the idler spindles 122, 124, 126, 128 and 130 have idler rollers 136. The idler spindles 122,124,126, 128 130, and drive spindle 120 are generally alternately disposed on the left and right sides of the second assembly 34 to lengthen the total length of the moving belt 90 relative to the length of the inner reach 94. A motor 138 drives the drive spindle 120 to rotate in the clockwise direction thereby moving the belt 90 in the direction of arrow 139 and continuously retrogresses the portion of the belt 90 forming the inner reach 94 and pulling that portion out of the path of the documents to distribute the wear over the entire length of the belt 90.

Referring to FIGS. 1A and 1B, in the preferred embodiment, the upper and lower stationary belts 100, 102 define a vertical plane which is substantially parallel to the plane defined by the drive belts 40 along the path 28. The idler roller 116, rotatably mounted to the left plate 96, is disposed within a notch 140 formed in the inner end 96a of the plate 96 so that the left end 118*a* of the inner reach 94 is slightly recessed from the plane defined by belts 100, 102. The idler roller 116, rotatably mounted to the right plate 98 is disposed so that the moving belt 90 is between and is substantially vertically aligned with the stationary upper and lower belts 100, 102. The coefficient of friction (μ) of the upper and lower belts 100, 102 is preferably less than the μ of the middle moving belt 90 thus making it easier for the document to glide along the upper and lower belts compared to the moving belt.

The differential in μ between the upper and lower stationary belts 100, 102 and the middle belt 90 is useful due to the fact that these belts perform three basic functions: a) they offer a lateral normal force for the drive belts 40 to work against; b) they constrain and support pieces of flat mail 14 with a column strength so they cannot roll or be folded, bent or crumpled; and c) they provide a hold back force so that "doubles" or two documents temporarily stuck together will not proceed past the nip 38 (FIG. 1).

Referring also to FIG. 2, placing the idler roller 116 in the notch 140 formed in the left support plate 96 places a left end portion 142 of the inner reach 94 of the moving belt 90, defined as extending between the left end 118*a* of the inner reach 94 and nip 38, rearward of the plane defined by belts 100, 102. Thus the moving belt 90 with its higher coefficient of friction, does not contact document 14*a* as the document advances toward nip 38. This eliminates the possibility of the moving belt 90 disadvantageously applying a hold-back force to document 14*a* in opposition to the forces applied by drive belts 40. At nip 38, all three belts 90, 100, 102 are coplanar and a hold back force is applied by belt 90 and in the region of the belt separator 10 beyond, or to the right of nip 38, as viewed in FIG. 1.

The moving drive belts 40 have a higher μ on the outer surface 44 than the highest μ of the stationary belts 100, 102 and moving belt 90. This relationship is important to enable the drive belts 40 to overcome the holding force of the hold back belts 90, 100, 102 and to advance documents along the path 28.

Referring again to FIGS. 1 and 2, it will become evident that while the drive belts 40 of the first assembly 30 define a first vertical planar contact surface and the belts 90, 100, 102 of the second assembly 34 generally define a second vertical planar contact surface, the relative spacing of the drive belts 40 and the hold back belts 90, 100, 102 is such that each of the drive belts is located in a vertical orientation between the stationary belts 100, 102 and the moving belt 90 and never contact the hold back belts. This relationship is designed to reduce wear on the moving drive belts 40 when documents are not being advanced along the path 28, which would otherwise occur if the first assembly 30 and second assembly 34 were positioned in opposing, contacting relationship.

It will also be evident from FIG. 1 that a portion 144 of the first assembly 30, defined by the portion of belt 40 extending adjacent spindles 48, 50, and 52, is positioned so that the drive belts 40 begins to project across the path 28 at nip 38 and continue the projection until spindle 48, with the greatest amount of projection being adjacent spindle 50. This occurs because spindles 48, 50 are mounted closer to the path 28 than spindle 52 but the idler roller 60 on spindle 48 has a smaller diameter than the idler roller 62 on spindle 50. This arrangement is preferred so that sufficient pressure is exerted by the drive belts 40 on each flat document 14 to ensure its advance along the path 28.

As the drive belts 40 advance each of the documents 14*a* by frictionally engaging the front surface 66 of the documents, rear surfaces 146 of the documents frictionally rub against the upper and lower stationary holdback belts 100, 102 and moving belt 90. This frictional rubbing may cause the wearing of the surfaces of the hold back belts 90, 100, 102 leading the belts to develop wear spots, particularly opposite the portion 144 of the first assembly 30 where the drive belts 40 project in between the hold back belts. To reduce the wear cause by the frictional rubbing, the upper and lower stationary belts 100, 102 are preferably composed of a slick material with a very low coefficient of friction. The slick material may be nylon or a teflon coated material or the like. Making the upper and lower holdback belts 100, 102 of a material having a low coefficient of friction still allows the belts to offer a lateral normal force for the drive belts 40 to work against and also constrain and support the documents with column strength.

As noted above, the wear caused by the frictional rubbing of the documents 14*a* on the hold back belt 90 is distributed over the length of the belt 90 by moving the belt around the drive spindle 120 and idler spindles 122, 124, 126,128, 130 so that the portion of the belt forming the inner reach 94 is changed. Also, to provide a long length of the hold back belt 90 for distribution of the wear, the belt is wound around the drive spindle 120 and idler spindles 124, 126, 128 and 130 alternately disposed on the left and right sides of the second assembly 34, as seen in FIG. 1.

In addition to wear, the rubbing friction may cause the deposit of residue from the rear surface 146 of the document 14 on the surface of the moving hold back belt 90. To remove this residue, the second assembly 34 may include a rotary brush 148 which brushes the surface of the belt 90 after the belt has travelled through the inner reach portion 94. The rotary brush 148 may be driven by a motor 149 and is preferably disposed opposite idler spindle 122 with the corresponding idler roller 136 offering a lateral normal force to work against.

One of the idler spindles 128 is rotatably mounted on one end of a pivot arm 150 with the other end of the pivot arm secured to the frame 12. The pivot arm 150 is biased by a spring 152 attached to the outer end 96*b* of the left support plate 96. In this manner, the spring maintains a predetermined tension on the belt 90 which keeps the belt taught, yet provides slack when the force of the spring is overcome, such as when a thick document is advanced along the path 28. The idler spindles 122, 124, 126 and 128 are rotatably mounted to the frame 12 by bearings 158 housed in the frame 12 as is well known to skilled practitioners.

Figure 3:
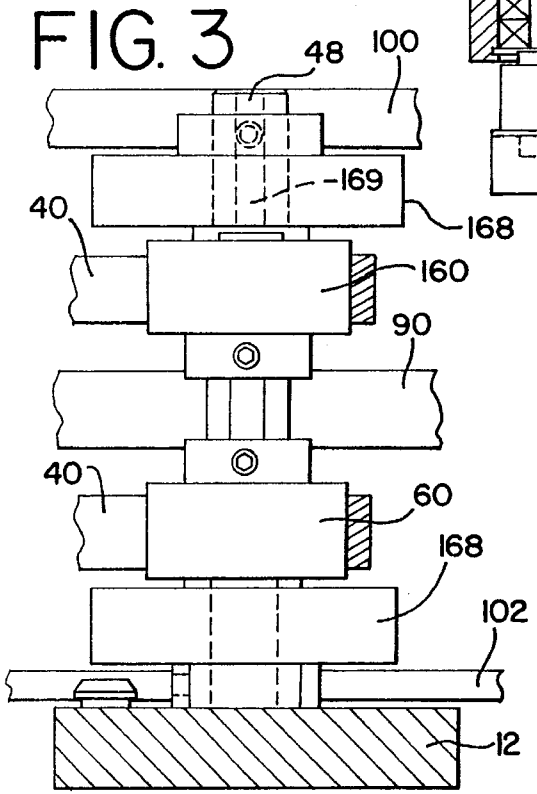
FIG. 3 is a section taken along the line of 3—3 of FIG. 1 and in the direction indicated generally.

Referring to FIGS. 1 and 3, an accelerator roller assembly, generally designated 160, is positioned to engage individual flat documents 14, and initially the document 14*a*, in the path 28 to complete the separation from the shingled array 26. The accelerator roller assembly 160 is provided to increase the velocity of the lead document 14*a* to be processed by additional handling equipment such as a high speed conveying apparatus 162.

In the preferred embodiment, the accelerator roller assembly 160 includes two opposing pairs of driven or powered rollers which straddle the path to form a nip 164. The first pair of driven rollers 168 are mounted on a spindle 169 within the inner drive spindle 48. The driven rollers 168 may be driven by two different driven mechanisms. The driven rollers 168 may be driven through a one way clutch and gear ratio connection between spindle 179 and the inner drive spindle 48 so that rotation of the idler rollers 60 by movement of the drive belts also drives the accelerator rollers 168 at a slightly higher rotational speed than the rollers 60. In addition, the clutch connection allows the accelerator rollers 168 to be rotated independently of the idler rollers 136 by a suitable drive means such as a motor 170 through a drive belt 172 extending about spindle 169.

As will be evident from FIG. 3, the rollers 168 are vertically spaced on the spindle 48 to provide the accelerated document with further column support, while being horizontally aligned so as not to interfere with the drive belts 40 or the hold back belts 90, 100, 102. Referring back to FIG. 1, in addition the circumferential surfaces of the rollers 168 project into the document path 28 farther than the outer surface 44 of the drive belts 40 as the drive belts extend about the idler rollers 60, to engage the front surface 16 of the document. This arrangement is preferred to prevent the drive belts 40 from engaging and holding back the document 14 when the accelerator rotors 168 are driven by the motor 170 and the drive belts 40 are stationary.

Referring to FIGS. 1 and 1C, a second pair of accelerator drive rotors 174 include an upper accelerator roller 176 mounted to an upper spindle 178 and a lower roller 180 mounted to a lower spindle 182. The upper spindle 178 and lower spindle 182 are respectively mounted to one end of corresponding pivot arms 184 and 186. The other end of the upper and lower pivot arms 184, 186 are pivotally mounted to vertical spindle 188 and biased by springs 190 for engagement at the nip 164 as well known in the art. The accelerator rollers 176, 180 are driven by the motor 170 through extension of drive belts 191 about the accelerator spindle 169, a pair of idler rollers 192 and spindle 188. The rotation of spindle 188 rotates pullies 196, drive belts 198 and accelerator rollers 176, 178.

Referring to FIG. 1, the separator apparatus 10 is also preferably provided with a sensor system, generally designated 200, for monitoring the presence of documents 14 in the path 28 so that a relatively constant flow of documents is advanced along the path. Although the sensor system 200 may take many forms is as well known to skilled practioners, in the preferred embodiment the system includes a set of two (2) photocells 202 and 204 which are connected to control module, shown diagrammatically at 212. The module 212 is also connected to a set of sensors shown diagrammatically at 206 and a control element (not shown) for the document feeder 18.

The photo cell 202 is preferably located in the high speed conveying apparatus 102 and straddles or throws the beam across the path 28 to detect a gap or spacing between documents. Such gap is indicative of a lack of documents 14 in the path 28 and a signal generated by the photo cell 202 triggers a command by the control module 212 to activate the drive motor 170 to drive the accelerator roller assembly 160. When the beam from photocell 202 is interrupted, a signal by the photocell triggers a command by the control module to deactivate motor 170 and cease driving the accelerator rollers 168, 174.

The photo cell 204 is preferably located at the nip 164 formed by the accelerator roller assembly 160 and is also positioned to straddle the path 28. When each document 14 passes the photo cell 204, the beam is interrupted which generates a signal to the control module 212 to deactivate the motor 138 stopping the drive belts 40 from advancing documents to the accelerator roller assembly 160. In the absence of a document, the beam is not interrupted and the drive belts 40 engage and transport document 14*a* to the accelerator roller assembly 168.

The photo cells 206 and may include a plurality of photocells are preferably located from the document feeder to the entrance nip 38. The photo cells 206 are positioned to straddle the path 28 and in dependence on whether the photo cells 206 are blocked and the drive belts are activated or stationary, the control module 212 activates or deactivates the document feeder 18.

It will be appreciated that the sensor system 200 will result in intermittent operation of the feeder 18 and resulting intermittent feeding of documents 14 onto the path 28. However, the flow of documents along the path 28 will be relatively uniform. Further, it is contemplated that other equivalent sensing devices commonly known in the art, including, but not limited to encoders may be positioned in operational relationship to the separator 10 to achieve the above identified relatively constant flow of documents through the separator 10.

A transport roller assembly is generally designated at 216 and is positioned to engage flat documents being advanced by the accelerator roller assembly 160 and transport the documents through the space or gap between the singulator 10 and high speed conveying apparatus 102. In the preferred embodiment, the transport roller assembly 216 is mounted just to the right of the accelerator roller assembly 160, however, other mounting positions are contemplated.

The transport roller assembly includes a driver roller 218 and an idler roller 220 which straddles the path 28 to form nip 224. The driver roller 218 is attached to a spindle 226 and the roller and spindle are mounted to a pivot arm 228 pivotally secured to the frame 12. The arm is biased for engagement at the nip 224 by a spring (not shown) as is well known in the art. The driver roller 218 is driven by a drive belt 230 and pulley 232 which is driven by a drive means (not shown) forming a part of the high speed conveying apparatus 102.

The idler roller 220 is rotatably mounted to an "L" shaped bracket 236 and extends through a notch 238 (FIG. 1B) formed in the right vertical support plate 98. The bracket 236 is rotatably mounted to a vertical rod 240. To bias the idler roller 220 into engagement with the driver roller 218, a spring 242 is attached to the bracket 236 with the other end of the spring operatively attached to hook post 112.

Figure 4:
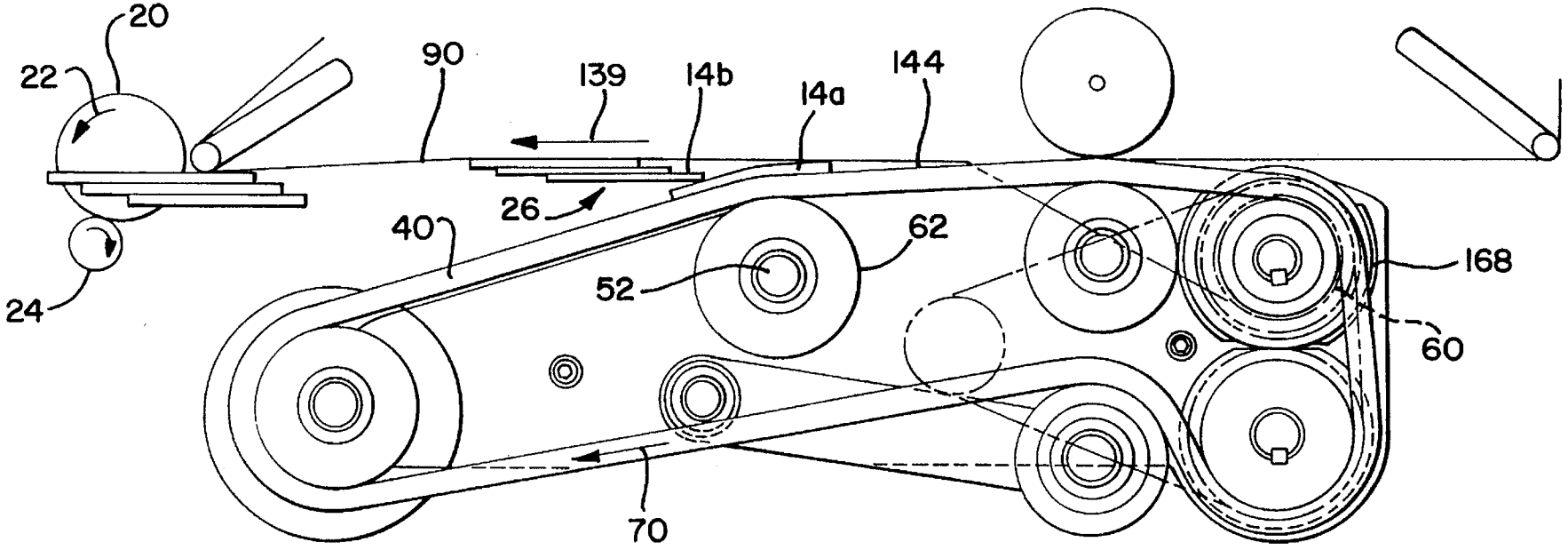
FIG. 4 is a diagrammatic overhead plane view of a representative shingled array of four documents indicated at the entrance nip of the present apparatus.

In operation, and referring to FIGS. 1 and 4, once the control module 212 is triggered to activate the document feeder 18, a shingled array 26 of documents 14 is fed into the entrance portion 36 of the separator 10. Each shingled array 26 includes a forward most lead document **14*a* which is moving faster than subsequent document as it reaches the entrance nip 38. At a point 250 (best seen in FIG. 1), the front surface 66 of the document 14*a* would be engaged by the outer surface 44 of both drive belts 40. Since the μ of the surface 44 is greater than the μ between the first document 14*a* and the second document 14*b*, the document 14*a* is pulled forward toward the entrance nip 38 by the belts 40**.

During this time, the second document **14*b* and any other documents in the array 26 engage hold back belts 90, 100, 102 of the second or hold back assembly 34. The document feeder 18 pushes the array 26 toward the entrance nip 38. Since the document 14*a* is traveling along the path 26 at a greater velocity than the remainder of the array 26, it reaches the nip 38 first, and then is advanced into the portion 144 of the moving first assembly under the influence of belt 40**.

In portion 144 of the separator 10, the disposition of the drive belts 40 and the hold back belts 90, 100, 102 defines substantially vertical, opposer planar contact surfaces which extend over a substantial planar area relative to the front surface 66 and rear surface 146 expectively, of the document **14*a* being contacted by the moving belts 40 to move the document along the path 28. Thus, both the drive belts and moving and stationary hold back belts combine to provide column strength to the documents 14** held therebetween as the documents are advanced along the path. This column support prevents each document from being bent, rolled, crumpled or otherwise damaged during the separation process for retaining each document in a confined spaced during advancement.

As seen in FIG. 4, in conjunction with FIG. 3, the hold back belts 90, 100, 102 conform to the shape of the document array 26 due to the biased mounting of the belts 100, 102 and the extension of the belt 90 about the idler spindle 130 mounted on the biased pivot arm 150. These mounting arrangements provide the hold back belts 90, 100, 102 with the necessary slack to conform to documents of varying thicknesses. It will be appreciated to achieve the desired column support, the document occupies a significant portion of the lateral space between the moving first assembly 30 and the hold back assembly 34. As the initial document **14*a* passes the entrance nip 38, the position of the drive belts 40 ensures a positive engagement of the document between the first and second assemblies 30 and 34. Specifically, the drive belts 40 extend rearwardly across the path 28 into the plane defined by the hold back belts 90, 100, 102**.

The positioning of the idler roller 62 mounted on spindle 52 provides a normal force which exerts a pressure on the held back document **14*b* which causes it to be engaged by the moving hold back belt 90. This belt preferably has a higher μ than the hold back belts 100, 102 and exerts a holding force on the document 14*b*, as well as any other documents in the array 26, as illustrated in FIG. 4. The retrogressive movement of belt 90 is slow enough to prevent the moving of the array 26 out of the nip 38 during separation of the documents 14**.

Additionally, the placement of the spindle 50 closer to the path 28 than spindle 52 with both spindles having generally equal size rollers forces belts 40 toward hold back belts 90, 100, 102 to provide additional normal force along the operative length of belts 40 at portion 144 of the first assembly 30. This prevents slack in belts 40 between nip 38 and the drive roller 60, and maintains belts 40 in engagement with document **14*a***.

As the drive belt engages the front surface 66 of the lead document **14*a* and separates the document from the array 26, the rear surface 146 of the document rubs along the hold back belts 90, 100, 102. The dragging of the document 14a creates little wear of the stationary hold back belts 100, 102 due to their low coefficient of friction (μ); however, the dragging does generate a certain degree of wear on the hold back belt 90. The dragging of the forward document 14*a* against the hold back belt 90, is primarily concentrated in or in close proximity to the portion 144 of the first assembly and with the high volume of documents typically being separated in the singulator 10, even a small degree of wear may eventually generate a wear area on the belt 90. Therefore, as a separator 10, is separating the documents, the second assembly 34 creates a continuous movement of the belt 90 in the direction of arrow 139 to continuously retrogress the length of belt forming the belt portion which extends along the path 28** to distribute the wear over the entire length of belt.

Once the initial document **14*a* is advanced through the portion 144 of the separator 10, the moving drive belts 40 contact the front surface of document 14*b* and overcome the holding force of the hold back belt 90 to advance the document 14*b* into the path 28 in the same manner as the document 14*a*. Each document 14 in the shingled array 26 will be similarly advanced seriatim through the separator 10 until, with the passage of the last document, a gap is sensed by the photocells 206 to trigger the feeder 18 to advance another array 26 to the entrance nip 38. Documents 14 can be continually or intermediately fit through separator 10** depending upon the requirements of the equipment downstream of the separator.

Referring to FIGS. 1 and 1C, an additional feature of the separator 10 is shown. This feature relates to the distributing of the contact between the hold back belt 90 and the document **14*a* along the length of the document particularly when thick documents are being separated by the separator 10. It is believed that when a thick document 14*a* is separated and passes through the portion 144 between the entrance nip 38 and accelerator roller assembly 160, the contact force between hold back belt 90 and document 14***a* becomes concentrated at the forward and rearward edges of the document. Such a concentrated force may cause a high degree of wear on the belt 90. To distribute the force over the length of the contact between the belt 90 and document 14*a*, the separator 10 includes a biasing roller, indicated at 260. The assembly 260 includes a roller 262 composed of a material which may be compressed and offer a biasing force opposing the compression. Such materials may include foam or the like. The roller 262 is mounted on spindle 264 such that the outer circumferential surface of the roller contacts the rear surface of the moving belt 90, as viewed from the front 16 of the separator 10. As the belt 90 is retrogressed through the document path 28, the roller 262 may rotate about the spindle to maintain contact with the belt 90, but offer little resistance to its movement. When a thick document 14*a* passes through the portion 144 and pushes the belt 90 rearward, the roller 262 contacts the rear surface and presses the belt 90 against the document 14*a* so that the contact force is distributed.

A specific embodiment of the novel High Speed With Movable Hold Back Belt for High Speed Flats Feeder according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

What is claimed is:

1. An apparatus for separating and advancing documents, said apparatus comprising:

a first assembly for frictionally engaging and advancing one of said documents along a path;

a second assembly for frictionally engaging and halting the advance of the remainder of said documents;

said first assembly and said second assembly being disposed in juxtaposition whereby said one document is gripped between said first assembly and said second assembly and advanced along said path under the influence of said first assembly;

said first assembly including first contact surface means which extend over a first substantial planar area relative to a first surface of said one document being contacted by said first assembly;

said second assembly including second contact surface means which extend over a second substantial planar area relative to a second surface of said one document being contacted by said second assembly, said first assembly and said second assembly contacting said first and second surfaces, respectively, of said one document over said first and second substantial planar areas thereby preventing portions of said one document from being crimped between said first assembly and said second assembly; and said second assembly including belt means extending adjacent said path for supporting said one document, said belt means comprising at least one fixed belt having a first coefficient of friction, and at least one moving belt having a second coefficient of friction.

2. The apparatus of claim 1 wherein said moving belt includes an endless belt and said second assembly includes means for retrogressingly moving said moving belt means adjacent said path to distribute wear along the entire length of said endless belt.

3. The apparatus of claim 2 wherein said second assembly includes brush means operably contacting said endless belt to remove residue from said endless belt.

4. The apparatus of claim 1 wherein said second assembly includes means for resilient lateral movement of said at least one fixed belt and said moving belt as said one document moves along said path in the grip of said movable element and said fixed belt means.

5. The apparatus of claim 4 including means contacting a surface of said moving belt opposite said path for applying a biasing force agains said moving belt in opposition to said lateral movement of said moving belt.

6. The apparatus of claim 1 further including accelerator means means forming a nip along said path for engaging said one document as said one document advances along said path and for increasing the velocity of said one document along said path.

7. The apparatus of claim 6 wherein said first assembly comprises movable belt means extending about at least one drive rollers and a plurality of idler rollers, said acclerator means including at least one accelerator roller forming a portion of said nip, said acclerator roller being operationally engaged to at least one of said idler rollers and said drive roller.

8. The apparatus of claim 7 further including first and second sensing means for sensing the presence of documents at predetermined points along said path; and control means connected to said first sensing means, said second sensing means, said first assembly and said accelerator means, said control means operationally engaging said accelerator means when said first sensor senses the absence of a document and operationally engaging said first assembly when said second senses the absence of a document.

9. The apparatus of claim 1 wherein said first assembly comprises movable belt means having a first portion defining a document entrance means, and a second portion for applying a force to said one document to grip said one document between said one second portion of said of said movable belt and said second assembly;

said second portion of said movable belt means extending about at least one drive rollers and a plurality of idler rollers, one of said idler rollers extending said second portion of said belt means towards said second assembly to enhance the gripping of said one document by said movable belt means and said second assembly.

10. The apparatus of claim 1 wherein said first assembly comprises movable belt means having a first portion defining a document entrance means, and further including first sensing means for sensing the absence of documents in the path; and second sensing means for sensing when said plurality of documents is located at said document entrance means.

11. An apparatus for separating and advancing documents, said apparatus comprising:

a first assembly for frictionally engaging and advancing one of said documents along a path;

a second assembly for frictionally engaging and halting the advance of the remainder of said documents;

said first assembly and said second assembly being disposed in juxtaposition whereby said one document is gripped between said first assembly and said second assembly and advanced along said path under the influence of said first assembly;

said first assembly including first contact surface means which extend over a first substantial planar area relative to a first surface of said one document being contacted by said first assembly;

said second assembly including second contact surface means which extend over a second substantial planar area relative to a second surface of said one document being contacted by said second assembly, said first assembly and said second assembly contacting said first and second surfaces, respectively, of said one document over said first and second substantial planar areas thereby preventing portions of said one document from being crimped between said first assembly and said second assembly;

said second assembly including belt means extending adjacent said path for supporting said one document, said belt means including at least one stationary belt and at least one belt having a portion moving retrogressingly along said path, said stationary belt and said moving portion being located apart from each other in vertically spaced relationship and defining spaces between said stationary belt and said moving portion, said first assembly comprising a plurality of movable belts whereby each of said movable belts has a portion thereof extending adjacent said spaces between said stationary belt and said moving portion.

12. The device of claim 11 wherein said second assembly includes at least two stationary belts.

13. The device of claim 12 wherein said retrogressingly moving portion is disposed vertically between said stationary belts.

* * * * *